United States Patent [19]

Yanagawa et al.

[11] 4,161,644

[45] Jul. 17, 1979

[54] ELECTROPHOTOGRAPHIC APPARATUS COMPRISING IMPROVED THERMAL FIXING MEANS

[75] Inventors: Nobuyuki Yanagawa; Tsutomu Watanabe; Kazuaki Tagawa, all of Tokyo, Japan

[73] Assignee: Ricoh Co., Ltd., Tokyo, Japan

[21] Appl. No.: 834,983

[22] Filed: Sep. 20, 1977

[30] Foreign Application Priority Data

Sep. 24, 1976 [JP] Japan ..... 51/114493

[51] Int. Cl.[2] ..... H05B 1/00; G03G 15/20

[52] U.S. Cl. ..... 219/216; 219/388; 219/483; 219/492; 250/317

[58] Field of Search ..... 219/246, 388, 469, 483, 219/492, 501; 355/3 FU; 250/317-319; 432/59, 60, 227, 228

[56] References Cited

U.S. PATENT DOCUMENTS

| | | | |
|---|---|---|---|
| 3,364,338 | 1/1968 | Holtkamp | 219/492 |
| 3,505,497 | 4/1970 | Lawes et al. | 219/216 |
| 3,532,855 | 10/1970 | Van Cleave | 219/501 X |
| 3,697,722 | 10/1972 | Furuichi et al. | 219/216 |
| 3,772,497 | 11/1973 | Gray et al. | 219/216 |
| 3,783,235 | 1/1974 | Sprague | 219/216 |
| 3,916,146 | 10/1975 | Hutner | 219/216 |
| 3,989,370 | 11/1976 | Mooney | 219/216 X |

*Primary Examiner*—C. L. Albritton
*Attorney, Agent, or Firm*—David G. Alexander

[57] ABSTRACT

An electric heater means thermally fixes a toner image to a copy sheet to produce a permanent electrostatic copy of an original document. The heater means is normally energized at partial power but is switched to full power by means of microswitches at the inlet and outlet of the heater means which are actuated by the copy sheet while the copy sheet passes through the heater means. The heater means is switched to full power for a shorter length of time during a multiple copy operation than during a single copy operation.

7 Claims, 6 Drawing Figures

ELECTROPHOTOGRAPHIC APPARATUS COMPRISING IMPROVED THERMAL FIXING MEANS

BACKGROUND OF THE INVENTION

The present invention relates to an electrophotographic apparatus comprising an improved thermal fixing means.

After a photoconductive drum of an electrostatic copying machine is exposed to a light image of an original document thereby forming an electrostatic image thereon, a toner substance is applied to the drum to develop the electrostatic image into a toner image. The toner image is then transferred and fixed to a sheet of copy paper to provide a permanent reproduction of the original document.

Fixing is generally accomplished by means of heat, pressure or a combination thereof. The present invention relates to the type of fixing means which utilizes electric heaters to radiate heat onto the copy sheet to fix the toner image thereto by means of fusion.

It has heretofore remained a problem to maintain the heaters at the proper constant temperature. One expedient which has been proposed is to sense the temperature in the fixing means utilizing a thermistor or similar electronic heat sensor and alternately turn the heaters on and off in accordance with the output signal from the thermistor to maintain the temperature at a predetermined value. While such a system generally works, the thermistor and comparator circuitry required are costly and tend to malfunction often. Also, the response time of the heaters is too long to effect precise temperature control.

Another prior art expedient has been to provide the heaters with a high thermal coefficient, thereby minimizing the flucuations in temperature caused by varying thermal load due to the number of copies produced and other factors. While this expedient does help somewhat, it leads to substantially increased power consumption.

Another expedient has been to energize the heaters constantly at a level of power such as to maintain the heaters at the required temperature. In addition to being sensitive to variations in thermal load, this expedient involves a substantial waste of power since the fixing means only needs to be maintained at its operating temperature when a copy sheet is actually passing therethrough.

SUMMARY OF THE INVENTION

The present invention overcomes the above problems which have heretofore existed in the prior art by providing microswitches at the inlet and outlet of the heater means. These microswitches are actuated by the copy sheet and cause the heater means to be energized at full power as the copy sheet passes therethrough and at partial power at other times. The heater means is switched to full power for a shorter length of time when a number of copies are to be made than when a single copy is to be made.

It is an object of the present invention to provide an electrophotographic apparatus comprising an improved thermal fixing means which overcomes the abovementioned drawbacks of the prior art.

It is another object of the present invention to reduce the power consumption of a thermal fixing apparatus.

It is another object of the present invention to improve the temperature stability of a thermal fixing means.

It is another object of the present invention to reduce the cost and complexity of a control system for a thermal fixing means.

It is another object of the present invention to provide a generally improved electrophotographic apparatus.

Other objects, together with the foregoing, are attained in the embodiments described in the following description and illustrated in the accompanying drawing.

DESCRIPTION OF THE PREFERRED EMBODIMENTS

While the electrophotographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
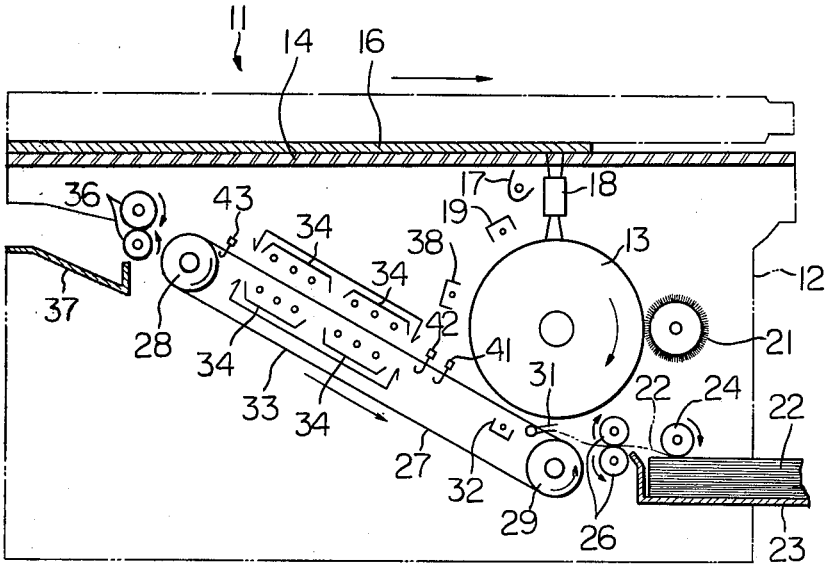
FIG. 1 is a schematic view of an electrophotographic apparatus embodying the present invention.

Referring now to FIG. 1 of the drawing, an electrophotographic apparatus embodying the present invention is shown as being in the form of an electrostatic copying machine 11 having a housing 12 which encloses a photoconductive drum 13. The drum 13 is rotated clockwise at constant speed. A glass platen 14 supports an original document 16 for electrostatic reproduction face down and an illumination lamp 17 illuminates the document 16 from below through the platen 14. The platen 14 and document 16 are moved rightwardly at the same surface speed as the drum 13 for scanning. A focussing optical fiber array 18 disposed between the platen 14 and drum 13 focusses a light image of a linear portion of the document 16 (perpendicular to the scan direction) onto the drum 13. Prior to imaging, a charging unit 19 forms a uniform electrostatic charge on the drum 1. The light image causes localized photoconduction of the drum 13 to progressively form an electrostatic image thereon. A magnetic brush developing unit 21 applies a toner substance to the drum 13 to form a toner image thereon.

A plurality of copy sheets 22 are provided in a cassette 23 in the form of a stack. A feed roller 24 is urged downwardly against the top sheet 22 of the stack. As the leading edge of the toner image on the drum 13 approaches the roller 24, the roller 24 is energized for one rotation thereby feeding the top copy sheet 22 into the bite off feed rollers 26. An endless chain 27 is trained around sprockets 28 and 29 and carried a clamp 31 thereon. During a previous operation, the chain 27 was rotated to the illustrated position and stopped so that the clamp 31 is open and adjacent to the feed rollers 26. The operation is timed so that the leading edge of the copy sheet 22 is fed by the feed rollers 26 into the bite of the clamp 31 just as the leading edge of the toner image on the drum 13 reaches the clamp 31. The sprockets 28 and 29 are then driven for rotation and the clamp 31 closed. In this manner the chain 27 carries the copy sheet 22 in engagement with the surface of the drum 13 at the same surface speed thereas with the toner image on the drum 13 aligned with the copy sheet 22.

A transfer charger 32 is disposed below the drum 13 and applies an electrostatic charge to the copy sheet 22 of the same polarity as the electrostatic image on the drum 13. This causes the toner image to be transferred from the drum 13 to the copy sheet 22. The copy sheet 22 is then carried by the chain 27 through a thermal fixing unit 33 comprising heaters 34 which cause the toner substance to fuse to the copy sheet 22. As the clamp 31 passes over the sprocket 28 it is opened and the copy sheet 22 is fed into the bite of feed rollers 36 which discharge the copy sheet 22 into a receiving tray 37 from which it is removed for use. After these operations are completed, the platen 14 is returned to its initial position in the leftward or return direction.

Figure 3:
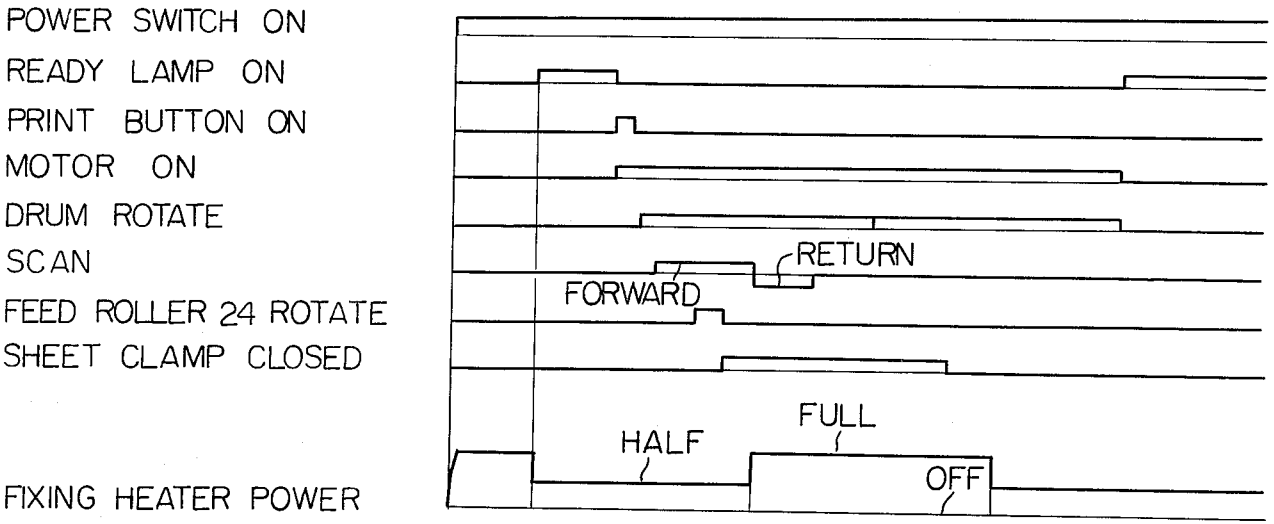
FIG. 3 is a timing diagram of the apparatus.

These operations are illustrated in FIG. 3. Further illustrated are the operations of turning on a power switch, lighting of a ready lamp (not shown) when the heaters 34 have been energized for a predetermined length of time, momentarily pressing a print button which starts the copying operation and turns off the ready lamp and energizes a motor (not shown) which drives the drum 13 and the various rollers. The rotation of the drum 13 and the forward (scan) and return movements of the platen 14 are also illustrated as well as the rotation of the feed roller 24 and the closure of the sheet clamp 31.

A discharge unit 38 dissipates any remaining electrostatic charge on the drum 13 after the toner transfer operation. During a second rotation of the drum 13 the developing unit 21 is utilized to remove any residual toner substance from the drum 13. Thus, the copying operation requires two rotations of the drum 13.

In accordance with the present invention microswitches 41 and 42 are provided at the inlet (not designated) of the fixing unit 33 with the microswitch 41 being upstream of the microswitch 42. The microswitches 41 and 42 are normally open and are closed through engagement with the copy sheet 22 as the same passes through the fixing unit 33. Located at the outlet of the fixing unit 33 is another microswitch 43 which is normally open and is closed by the copy sheet 22 through engagement therewith.

Figure 4:
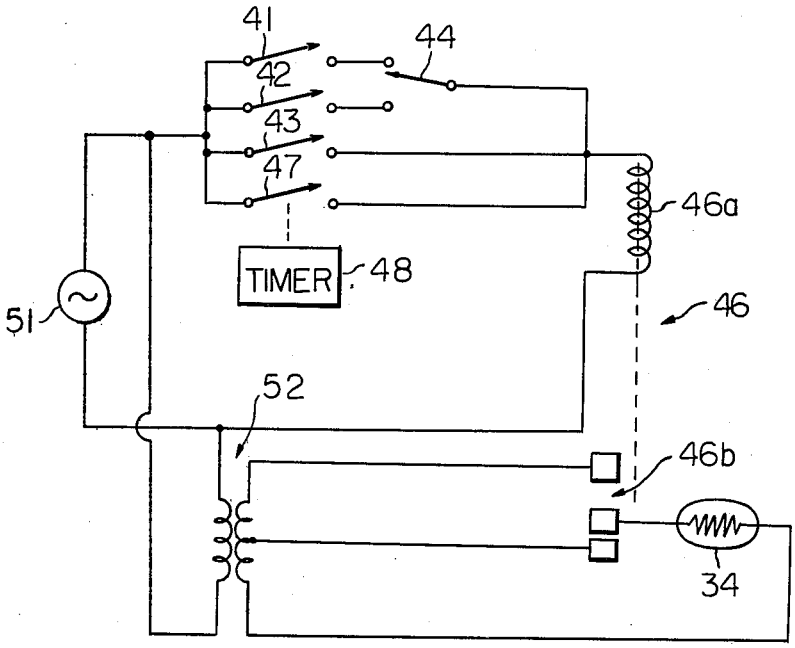
FIG. 4 is an electrical schematic diagram of a first embodiment of a thermal control means for the fixing means of the apparatus.

Referring now to FIG. 4, it will be seen that the microswitches 41 and 42 are single-pole, single-throw and comprise movable contacts (not designated) which are connected to one end of an A. C. power source 51. The fixed contacts of the microswitches 41 and 42 are connected to the fixed contacts of a single-pole, double-throw switch 44. The movable contact of the switch 44 is connected through a coil **46*a* of a relay 46 to the other end of the power source 51. The microswitch 43 is connected in parallel with the switches 41, 42 and 44. A switch 47 controlled by a timer 48 is connected in parallel with the microswitch 43**.

Further connected across the power source 51 is the primary coil of a multiple output transformer 52. The secondary winding of the transformer 52 is connected at one end to the upper fixed contact of a single-pole, double-throw set of relay contacts **46*b* of the relay 46 and at the other end to one end of the heaters 34. In this case, the heaters 34** are assumed to be connected in parallel to constitute one heater.

The center tap of the transformer 52 is connected to a lower fixed contact of the relay contacts **46*b*. The movable contact of the relay contacts 46*b* is connected to the other end of the heaters 34**.

In operation, when the power switch (not shown) is first closed, the timer 48 closes the switch 47 for a predetermined length of time. This completes a circuit between the power source 51 and relay coil **46*a*. The movable contact of the relay contacts 46*b* normally engages with the lower fixed contact thereof which is connected to the center tap of the transformer 52. This connects the heaters 34 across the center tap of transformer 52, thereby energizing the heaters 34 at one-half power. However, energization of the relay coil 46*a* causes the movable contact of the relay contacts 46*b* to engage with the upper fixed contact thereof, thereby connecting the heaters 34 across the entire secondary winding of the transformer 52. Thus, the heaters 34 are energized at full power. When the timer 48 times out, the switch 47 is opened, the relay coil 46*a* de-energized and heaters 34 switched back to half-power. This operation is illustrated in FIG. 3. Thus, the heaters 34** are initially brought up to operating temperature.

Where only a single copy is to be made the movable contact of the switch 44 is moved by a control unit (not shown) of the apparatus 11 into engagement with the fixed contact of the microswitch 41. This enables the microswitch 41 and renders the position of the microswitch 42 irrelevant. As long as no copy sheet 22 is in passage through the fixing unit 33, the microswitch 41 remains open and one-half or partial power is applied to the heaters 34 for the reasons described above. However, when the leading edge of the copy sheet 22 engages with the microswitch 41, the same is actuated or closed. The effect is the same as closing the switch 47 since the relay coil **46*a* is energized through the switches 41 and 44. This causes full power to be applied to the heaters 34 for fixing the toner image to the copy sheet 22**.

As the leading edge of the copy sheet 22 reaches the microswitch 43, it engages with and closes the same. However, no effect occurs at this time since the microswitch 43 is closed in parallel with the switches 41 and 44. When the trailing edge of the copy sheet 22 passes the microswitch 41, the microswitch 41 opens. However, there is still no effect since the microswitch 43 is still closed. However, when the trailing edge of the copy sheet 22 clears the microswitch 43, the circuit to the relay coil **46*a* is opened since the microswitch 43 is opened. Thus, the heaters 34** are returned back to one-half power.

In summary, the heaters 34 are brought up to operating temperature quickly by means of the timer 48 which causes full power to be applied to the heaters 34 for a predetermined length of time. The timer 48 may comprise a mechanical or electrical timer. Alternatively, the timer 48 and switch 47 may be replaced by a normally closed thermostatic switch provided to the fixing unit 33 and connected in parallel with the microswitch 43 which opens after a predetermined length of time elapses and the fixing unit 33 reaches operating temperature. Thereafter, the heaters 34 are returned to half power and maintained at half power until the fixing unit 33 is actually used for thermal fixing. The heaters 34 preferably have a small heat coefficient so as to respond quickly to the power changes. As a copy sheet 22 is fed through the fixing unit 33, it first closes the microswitch 41 which causes full operating power to be applied to the heaters 34 to bring the same quickly up to operating temperature. The copy sheet 22 passes through the fixing unit 33 and the toner image is fixed thereto. As the trailing edge of the copy sheet 22 clears the microswitch 43, the same is opened returning the heaters 34 to partial or standby power.

Where a number of copies are to be made of a single original document, after each copy sheet is fixed the temperature of the heaters 34 does not have sufficient time to drop down to the standby temperature after being returned to half power where the microswitch 41 is used. Thus, the fixing unit 33 operates at an excessive temperature. To alleviate this undesirable effect, the microswitch 42 is provided between the microswitch 41 and the fixing unit 33. For multiple copying operations, the control unit (not shown) changes over the switch 44 so that the movable contact thereof engages with the fixed contact thereof which is connected to the microswitch 42. This enables the microswitch 42 and disables the microswitch 41. Thus, the heaters 34 are switched to full power when the copy sheet 22 engages with the microswitch 42 rather than the microswitch 41. In this manner, the heaters 34 are switched to full power comparatively later and for a shorter period of time. This allows the heaters 34 to return to standby operating temperature when switched back to half power and causes the fixing unit 33 to operate at the correct temperature during multiple copying operations.

Figure 2:
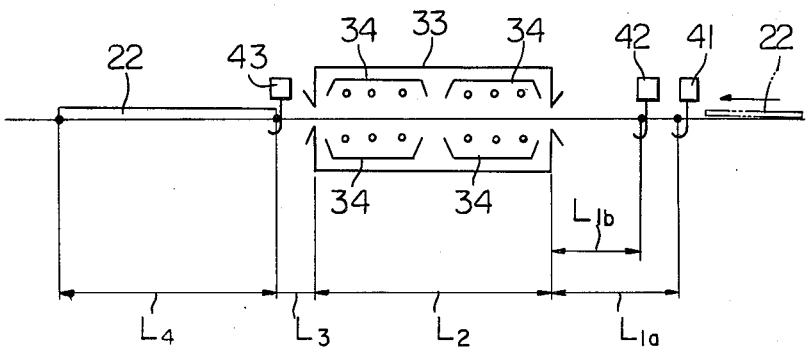
FIG. 2 is a diagrammatic view of a thermal fixing means of the apparatus.

As illustrated in FIG. 2, the distance between the microswitch 41 and the inlet of the fixing unit 33 is designated as $L_{1a}$. Similarly, the distance between the microswitch 42 and the inlet of the fixing unit 33 is designated as $L_{1b}$. The length of the fixing unit 33 is designated as $L_2$, and the distance between the outlet of the fixing unit 33 and the microswitch 43 is designated as $L_3$. The length of the copy sheet 22 is designated as $L_4$.

The length of time $t_1$ that the heaters 34 are switched to full power during a single copying operation is therefore $$t_1 = L_{1a} + L_2 + L_3 + L_4/V \quad \ldots (1)$$

where V is the speed of movement of the copy sheet 22 through the fixing unit 33. Similarly, the length of time $t_2$ that the heaters 34 are switched to full power during a multiple copying operation is $$t_2 = L_{1b} + L_2 + L_3 + L_4/V \quad \ldots (2)$$

Once it is determined how long the heaters 34 should be switched to full power for single and multiple operations ($t_1$ and $t_2$ respectively), the values of $t_1$ and $t_2$ can be realized in practical application through appropriate selection of the values of $L_{1a}$, $L_{lb}$ and $L_3$ in accordance with equations (1) and (2) above.

Figure 5:
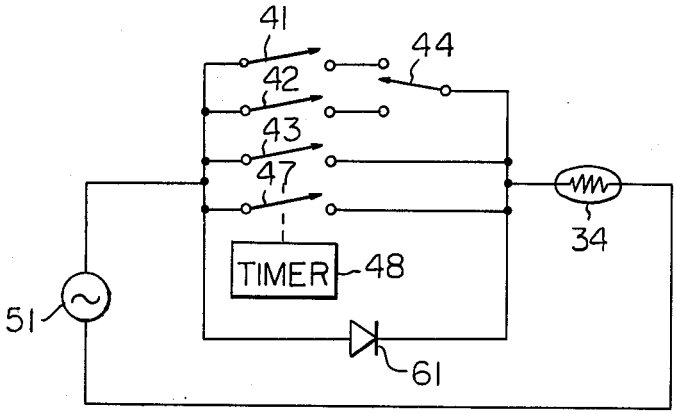
FIG. 5 is similar to FIG. 4 but shows a second embodiment of the thermal control means.

FIG. 5 illustrates another means for controlling the heaters 34 in which like elements are designated by the same reference numerals utilized above. The switches 41 to 44 and 47, in addition to the timer 48, power source 51 and heater 34 are connected in the same manner as in FIG. 4. However, in FIG. 5, a diode 61 is connected in parallel with the switch 47 and constitutes the means for controlling the power of the heaters 34.

When the fixing unit 33 is not in use and the switches 41, 42, 43 and 47 are open, the diode 61 is effectively connected in series with the power source 51 and heaters 34. This half-wave rectifies the power applied to the heaters 34 and effectively cuts the applied power in half. In accordance with well known diode action the diode 61 conducts in one direction but does not conduct in the opposite direction.

However, when either of the switches 41, 42, 43 and 47 is closed, the diode 61 is effectively shorted out and full power is applied to the heaters 34.

Figure 6:
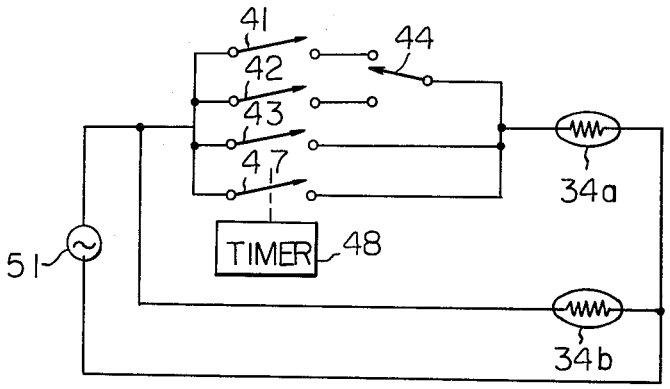
FIG. 6 is also similar to FIG. 4 but shows a third embodiment of the thermal control means.

FIG. 6 illustrates another temperature control means for the fixing unit 33 in which like elements are again designated by the same reference numerals. In this embodiment, the diode 61 is omitted. Furthermore, the heaters 34 are not all connected together in parallel. Instead, half of the heaters 34 are connected so as to take the place of the heaters 34 in FIGS. 4 and 5 and are designated as **34*a*. The other half of the heaters 34 are connected directly across the power source 51 and are designated as 34*b***.

In operation, the heaters **34*b* are energized at all times. When the fixing unit 33 is not in use, the switches 41, 42, 43 and 47 are all open and the heaters 34*a* are not energized. In effect, one half of the heaters 34 are energized and the fixing unit 33 is operated at half power. However, when the copy sheet 22 passes through the fixing unit 33 and one of the microswitches 41, 42, and 43 is closed, the heaters 34*a* are energized and the fixing unit 33 is operated at full power. In the embodiments of both FIGS. 5 and 6, the timer 48 closes the switch 47 to switch the heaters 34 to full power as in the embodiment of FIG. 4**.

In summary, it will be seen that the present invention overcomes the problem of temperature regulation of a thermal fixing unit of an electrophotographic apparatus using simplified, inexpensive and durable components. Various modifications will become possible for those skilled in the art after receiving the teachings of the present disclosure without departing from the scope thereof. For example, the rectifier diode 61 may be replaced by a thyristor and appropriate triggering circuitry. As another modification, circuitry may be provided to alternately pass and block electrical power to the heaters 34 such as passing one A. C. cycle and thereafter blocking one or more A. C. cycles.

What is claimed is:

1. An electrophotographic apparatus comprising:

electric heater means for thermally fixing a toner image to a copy sheet;

power source means operative to supply full electric power and partial electric power to the heater means; and switch means connected to the power source means and the heater means for controlling the power source means to normally supply partial power to the heater means and to supply full power to the heater means for a predetermined length of time as the copy sheet passes through the heater means;

the switch means being constructed to sense passage of the copy sheet through the heater means;

the switch means comprising a first switch provided at an inlet of the heater means which is actuated by engagement with the copy sheet and a second switch provided at an outlet of the heater means which is actuated by engagement with the copy sheet;

the first switch controlling the power source means to switch from partial power to full power and the second switch controlling the power source means to switch from full power to partial power;

the switch means further comprising a third switch provided between the inlet of the heater means and the first switch which is actuated by engagement with the copy sheet and means for selectively enabling the first and third switches during a single copy operation and a multiple copy operation respectively.

2. An apparatus as in claim 1, in which the power source means comprises a multiple output transformer.

3. An apparatus as in claim 1, in which the power source means comprises a rectifier.

4. An apparatus as in claim 1, in which the heater means comprises two heaters, one of the heaters being energized for partial power and both of the heaters being energized for full power.

5. An apparatus as in claim 1, further comprising timer means for initially controlling the power source means to apply full power to the heater means for a predetermined length of time.

6. An apparatus as in claim 5, in which the timer means comprises a timer.

7. An apparatus as in claim 5, in which the timer means comprises a thermostatic switch provided to the heater means.

* * * * *